US009746181B2

(12) United States Patent
Mori

(10) Patent No.: US 9,746,181 B2
(45) Date of Patent: Aug. 29, 2017

(54) FLAME DETECTING SYSTEM

(71) Applicant: Azbil Corporation, Tokyo (JP)

(72) Inventor: Raita Mori, Tokyo (JP)

(73) Assignee: Azbil Corporation, Tokyo (JP)

( * ) Notice: Subject to any disclaimer, the term of this patent is extended or adjusted under 35 U.S.C. 154(b) by 0 days.

(21) Appl. No.: 15/164,340

(22) Filed: May 25, 2016

(65) Prior Publication Data

US 2016/0348907 A1 Dec. 1, 2016

(30) Foreign Application Priority Data

May 26, 2015 (JP) ..... 2015-106035

(51) Int. Cl.

| | |
|---|---|
| ***G01J 1/42*** | (2006.01) |
| ***F23N 5/08*** | (2006.01) |
| ***F23N 5/24*** | (2006.01) |

(52) U.S. Cl.

CPC ..... *F23N 5/082* (2013.01); *F23N 5/242* (2013.01); *F23N 2023/04* (2013.01); *F23N 2023/08* (2013.01); *F23N 2023/12* (2013.01); *F23N 2029/00* (2013.01); *F23N 2031/10* (2013.01)

(58) Field of Classification Search

CPC ..... G01J 5/0014; G08B 17/125; F23N 5/082; F23N 5/242; F23N 2023/04; F23N 2023/08; F23N 2023/12; F23N 2029/00

See application file for complete search history.

(56) References Cited

U.S. PATENT DOCUMENTS

| | | | | |
|---|---|---|---|---|
| 4,249,168 A * | 2/1981 | Muggli | F23N 5/082 250/339.05 |
| 4,280,058 A * | 7/1981 | Tar | F23N 5/082 250/339.15 |
| 4,415,806 A * | 11/1983 | Tar | F23N 5/082 250/338.3 |
| 4,575,333 A * | 3/1986 | Bryant | F23N 5/203 431/18 |
| 4,665,390 A * | 5/1987 | Kern | G08B 17/12 340/578 |

(Continued)

FOREIGN PATENT DOCUMENTS

| | | |
|---|---|---|
| JP | H07-0318487 A | 12/1995 |
| JP | 2011-141290 A | 7/2011 |

OTHER PUBLICATIONS

Japanese Application No. JP2015-106035, filed May 26, 2015.

*Primary Examiner* — Marcus Taningco
*Assistant Examiner* — Djura Malevic
(74) *Attorney, Agent, or Firm* — Amster, Rothstein & Ebenstein, LLP

(57) ABSTRACT

A flame detecting system capable of easily performing a deterioration diagnosis of a flame sensor without being provided with a shutter mechanism. The flame detecting system comprising a flame sensor to detect light, a calculating device, and a reference light source, in which the calculating device, by operations of a central processing unit CPU, is configured to execute a first mode at which the discharge probability in the flame sensor is measured when the reference light source is turned off and a second mode at which the discharge probability in the flame sensor is measured when the reference light source is turned on, and calculate a current discharge probability of the flame sensor from data obtained at the first mode and the second mode.

3 Claims, 4 Drawing Sheets

(56) References Cited

U.S. PATENT DOCUMENTS

| | | | | | |
|---|---|---|---|---|---|
| 4,742,236 | A * | 5/1988 | Kawakami | G08B 17/12 | 250/554 |
| 5,153,673 | A * | 10/1992 | Amirav | G01N 27/626 | 356/315 |
| 5,237,512 | A * | 8/1993 | Davidson | G06K 9/46 | 340/578 |
| 5,333,487 | A * | 8/1994 | Kimura | G01N 21/69 | 356/313 |
| 5,365,223 | A * | 11/1994 | Sigafus | F23N 5/12 | 340/578 |
| 5,741,711 | A * | 4/1998 | Amirav | G01N 30/68 | 422/54 |
| 5,850,182 | A * | 12/1998 | Schuler | G08B 17/12 | 250/339.15 |
| 7,297,970 | B2 * | 11/2007 | Yamagishi | F23N 5/082 | 250/339.15 |
| 2006/0226995 | A1 * | 10/2006 | Yamagishi | F23N 5/082 | 340/578 |
| 2010/0013644 | A1 * | 1/2010 | McDonald | F23N 5/123 | 340/577 |
| 2015/0348393 | A1 * | 12/2015 | Margolin | F23N 5/123 | 340/577 |
| 2015/0369668 | A1 * | 12/2015 | Watabe | H01L 37/02 | 250/338.3 |

* cited by examiner

FLAME DETECTING SYSTEM

CROSS-REFERENCE TO RELATED APPLICATION

This application claims the benefit of and priority to Japanese Patent Application No. 2015-106035, filed on May 26, 2015, the entire contents of which are incorporated by reference herein.

TECHNICAL FIELD

The present invention is related to a flame detecting system that detects the presence or absence of a flame.

BACKGROUND ART

Conventionally, an electron tube which is used for detecting the presence or absence of a flame on the basis of ultraviolet rays emitted from the flame in a combustion furnace or the like has been known. The electron tube includes a sealed container in which predetermined gas is sealed and filled, an electrode supporting pin that penetrates through the sealed container, and two electrodes that are supported in parallel with each other by the electrode supporting pin within the sealed container. In the electron tube, when one electrode arranged to oppose the flame is irradiated with ultraviolet rays in a state where a predetermined voltage is applied across the electrodes through the electrode supporting pin, electrons are emitted from the one electrode due to the photoelectric effect and excited in succession one after another to cause an electron avalanche between the one electrode and the other electrode. Therefore, it is possible to detect the presence or absence of a flame by measuring a change in impedance between electrodes, a change in voltage between electrodes, and electric current flowing between electrodes. Various methods for detecting the presence or absence of a flame have been suggested.

In the related art, there has been suggested a flame sensor in which electric current flowing between electrodes is integrated and it is determined that a flame is present in a case where an integrated value is greater than or equal to a predetermined threshold value and a flame is absent in a case where the integrated value is less than the predetermined threshold value (for example, see PTL 1). However, the flame sensor is a product having a lifetime and needs to be replaced appropriately. For that reason, it is required to detect a deterioration tendency of the flame sensor.

In the technically related field, in an ozone concentration meter disclosed in PTL 2, an optical path of light which passes through a reaction cell and another optical path of light which does not pass through the reaction cell are switched by an optical chopper. Light passing through the reaction cell is assumed as measuring light, light not passing through the reaction cell is assumed as reference light, each quantity of light is detected by a light receiver, both quantities of light are subjected to signal processing and comparison and calculation processing by a measurement circuit and thus, an ozone concentration value is calculated. In this case, the ozone concentration meter copes with a temporal change of a lamp which emits ultraviolet rays, using reference light. As such, the ozone concentration meter is a technique in which reference light and measuring light are alternately measured even without removing a sensor to thereby detect a change in sensitivity of the sensor.

CITATION LIST

Patent Literature

[PTL 1] JP-A-2011-141290
[PTL 2] JP-A-07-318487

SUMMARY OF THE INVENTION

Problem that the Invention is to Solve

When it is intended to know the change in sensitivity of an electron tube for flame detection by using the conventional technique disclosed in PTL 2 in the flame detector disclosed in PTL 1, a chopper or a shutter mechanism which mechanically blocks measuring light during measurement of standard reference light is also required.

In order to solve the problem, the present invention measures sensitivity of an electron tube and diagnoses deterioration using a reference light source, instead of mechanical light blocking means, without being provided with the mechanical light blocking means, on the basis of a technique in which a quantity of received light can be uniquely obtained with computation by only measuring the number of peaks of an electrical signal flowing from a flame sensor.

Means for Solving the Problem

According to the present invention, there is provided a flame detecting system comprising a flame sensor to detect light, a calculating device, and a reference light source. In the flame detecting system, the calculating device includes an applied voltage generating portion configured to generate a pulse to drive the flame sensor, a voltage detecting portion configured to measure an electric signal flowing in the flame sensor, a storing portion configured to store sensitivity parameters provided in the flame sensor in advance, and a central processing unit configured to obtain a quantity of received light of flame using parameters of a known quantity of received light, a pulse width, and a discharge probability of the sensitivity parameters, and a discharge probability obtained from an actual pulse width and the measured number of discharge times. In the flame detecting system, the central processing unit is configured to execute a first mode at which the discharge probability in the flame sensor is measured when the reference light source is turned off and a second mode at which the discharge probability in the flame sensor is measured when the reference light source is turned on, and calculate a current discharge probability of the flame sensor from data obtained at the first mode and the second mode.

Furthermore, according to the present invention, the flame detecting system may obtain a quantity of received light of the flame from the current discharge probability of the flame sensor.

According to the present invention, the flame detecting system may perform a deterioration diagnosis of the flame sensor by comparing the current discharge probability or the quantity of received light with a predetermined threshold.

Advantage of the Invention

According to the present invention, an effect that a quantity of received light can be obtained with computation by a digital calculation using a known parameter group stored in advance, an actual operating quantity and a measurement amount and further, the deterioration of sensitivity of the electron tube can be determined easily and rapidly by adding parameters of the reference light source is obtained.

Figure 1:
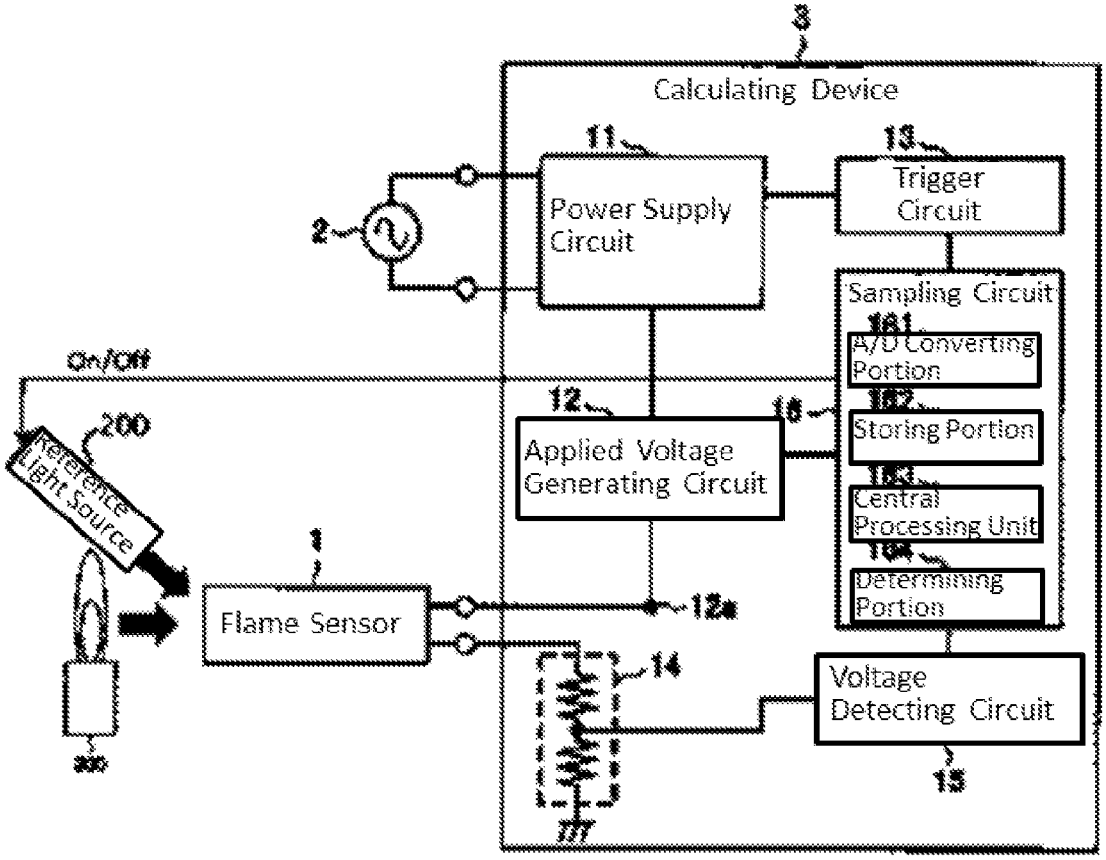
FIG. 1 illustrates a flame detecting system according to an embodiment of the present invention.

MODE FOR CARRYING OUT THE INVENTION (1) Configuration of the Present Invention A flame detecting system according to an embodiment of the present invention is illustrated in FIG. 1 and the configuration thereof will be described. The flame detecting system according to the present embodiment includes a flame sensor 1, an external power supply 2, and a calculating device 3 to which the flame sensor 1 and the external power supply 2 are connected. Further, a reference light source 200 is provided by being connected to the calculating device 3.

The flame sensor 1 is configured by an electron tube including a cylindrical envelope of which both ends are closed, an electrode pin that penetrates through the envelope, and two electrodes that are supported in parallel with each other by the electrode pin within the envelope. In such an electron tube, the electrodes are arranged to oppose a device, such as a burner, which generates a flame 300. With this, when the electrodes are irradiated with ultraviolet rays in a state where a predetermined voltage is applied across the electrodes, electrons are emitted from one electrode due to the photoelectric effect and excited in succession one after another to cause an electron avalanche between the one electrode and the other electrode. With this, a voltage, electric current, and impedance between the electrodes are changed.

The external power supply 2 is configured by a commercial AC power supply having a voltage value of, for example, 100 [V] or 200 [V].

The calculating device 3 includes a power supply circuit 11 connected to the external power supply 2, an applied voltage generating circuit 12 and a trigger circuit 13 that are connected to the power supply circuit 11, an output terminal 12*a* of the applied voltage generating circuit 12, a voltage dividing resistor 14 connected to an electrode pin of a downstream side of the flame sensor 1, a voltage detecting circuit 15 connected to the voltage dividing resistor 14, and a sampling circuit 16 to which the voltage detecting circuit 15 and the trigger circuit 13 are connected.

The power supply circuit 11 supplies the AC power received from the external power supply 2 to the applied voltage generating circuit 12 and the trigger circuit 13 and acquires power for driving the calculating device 3.

The applied voltage generating circuit 12 boosts the AC voltage applied by the power supply circuit 11 to a predetermined value and applies the AC voltage to the flame sensor 1. In the present embodiment, a pulsed voltage of 400 [V] is applied to the flame sensor 1.

The trigger circuit 13 detects a predetermined value point of the AC voltage applied by the power supply circuit 11 and inputs the detected result to the sampling circuit 16. In the present embodiment, the trigger circuit 13 detects a minimum value point at which a voltage value becomes a minimum value. In this manner, a predetermined value point regarding an AC voltage is detected and thus, it is possible to detect one cycle of the AC voltage.

The voltage dividing resistor 14 generates a reference voltage from a terminal voltage of the downstream side of the flame sensor 1 and inputs the reference voltage to the voltage detecting circuit 15. The terminal voltage of the flame sensor 1 is a high voltage of 400 [V] as described above and thus, if the terminal voltage is input to the voltage detecting circuit 15 as it is, a heavy load is imposed on the voltage detecting circuit 15. In the present embodiment, the presence or absence of the flame is determined not on the basis of an actual value of the voltage between the terminals of the flame sensor 1 but on the basis of the temporal change of the terminal voltage of the flame sensor 1, that is, a shape of a pulse waveform of the voltage value between the terminals for each unit time. Accordingly, by the voltage dividing resistor 14, the reference voltage in which the change in the voltage between the terminals of the flame sensor 1 is represented, and having a lower voltage value is generated, and the reference voltage is input to the voltage detecting circuit 15.

The voltage detecting circuit 15 detects the voltage value of the reference voltage input from the voltage dividing resistor 14 and inputs the voltage value to the sampling circuit 16.

The reference light source 200 is arranged to input light to the flame sensor 1 and is turned on and turned off under the control of the calculating device 3.

The sampling circuit 16 determines the presence or absence of the flame on the basis of the voltage value of the reference voltage input from the voltage detecting circuit 15 and a triggering time point input from the trigger circuit 13. In a case where flames occur and thus the flame sensor 1 is irradiated with ultraviolet rays, the electrodes are irradiated with ultraviolet rays and electrons are emitted from one electrode due to the photoelectric effect and the electrons are excited in succession one after another to cause an electron avalanche between the one electrode and the other electrode, and an electric current abruptly increases due to the electron avalanche such that emission of electrons accompanied by light emission occurs. Accordingly, the sampling circuit 16 obtains the quantity of received light with computation on the basis of a shape of a voltage waveform having such a pulse shape. The sampling circuit 16 includes an A/D converting portion 161 which generates a voltage value and a voltage waveform by performing an A/D conversion on the input reference voltage, a central processing unit 163 which analyzes the voltage value and the voltage waveform generated by the A/D converting portion 161 and performs calculation, which will be described later, and a determining portion 164 that determines the presence or absence of the flame on the basis of the quantity of received light calculated by the central processing unit 163.

(2) Operation of Flame Detection

Next, description will be made on operation of flame detection according to the present embodiment with reference to FIG. 2.

First, the calculating device 3 applies a high voltage to the flame sensor 1 by the applied voltage generating circuit 12. In such a state, the trigger circuit 13 applies a trigger when the AC voltage input to the power supply circuit 11 from the external power supply 2, that is, the value of the voltage applied to the flame sensor 1 by the applied voltage generating circuit 12 rises from the minimum value point.

Figure 2:
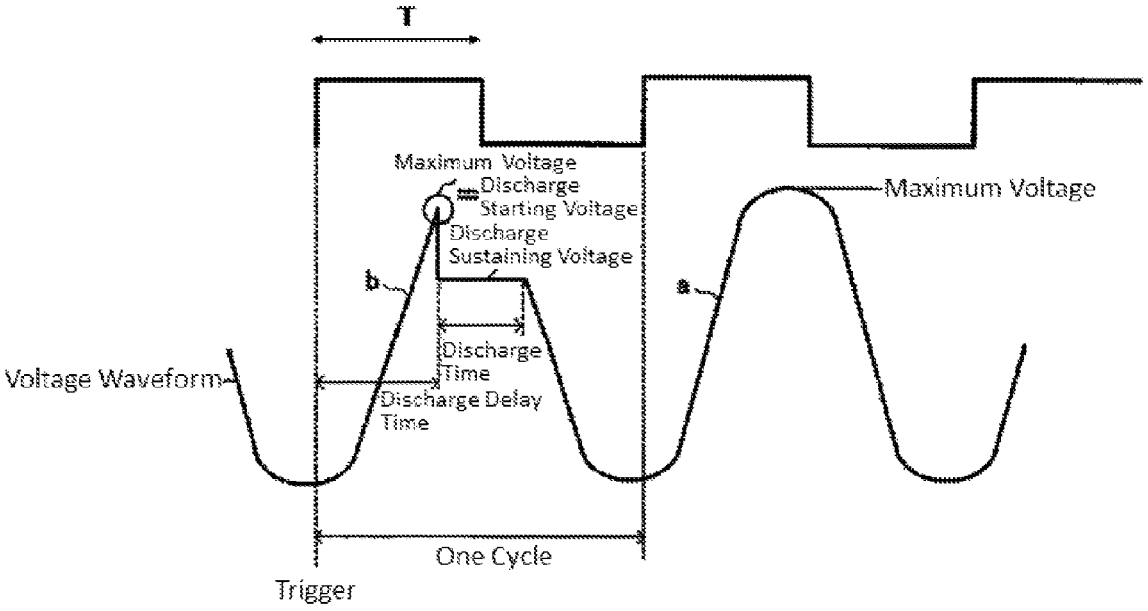
FIG. 2 is a waveform diagram for explaining a discharge waveform.

When the applied voltage passes through the minimum value point, a voltage waveform, which represents the temporal change of the voltage value illustrated in FIG. 2, is applied. As an example, in a case where the voltage value is detected every 0.1 [msec], when a frequency of the external power supply 2 is assumed as 60 [Hz], one cycle is 16.7 [msec] and thus, the voltage values detected for one cycle are 167 samples, and the sampled data is input to the central processing unit 163.

In the present example, in a case where the flame is not occurring, the voltage waveform atterminal 12*a* to be applied to the electrodes of the flame sensor 1 has a gentle shape having a sine wave (hereinafter, referred to as a "normal waveform") as illustrated in a reference symbol a of FIG. 2. On the other hand, in a case where the flame occurs and the flame sensor 1 is irradiated with ultraviolet rays, the voltage waveform has a characteristic shape (hereinafter, referred to as a "discharge waveform") in which the voltage value falls in the vicinity of the positive extreme value, the location where the voltage value has fallen continues for a predetermined time and then, the voltage waveform returns to the sine wave as illustrated in a reference symbol b of FIG. 2. One of the features of the present invention is to regard a state where the maximum voltage is equal to a peak of discharge starting voltage as a single discharge time by the voltage detecting circuit 15. In the meantime, a pulse width to drive the flame sensor 1 is denoted by T in the rectangular pulse illustrated in the upper part of FIG. 2.

In the meantime, it is appropriate for an actual circuit to have a DC circuit configuration and thus, the power supply circuit 11 or the applied voltage generating circuit 12 has an AC to DC converter built therein and the DC output voltage thereof is applied to the flame sensor 1. The discharge probability is obtained in the following sequence.

1. When a rectangular trigger controlled to have a width T is applied to the applied voltage generating circuit 12 from the central processing unit 163, an applying voltage is applied to the flame sensor 1 in synchronization with the trigger.

2. When the flame sensor 1 does not discharge, an electric current does not flow in the flame sensor 1 and the voltage dividing resistor 14 of the downstream side of the flame sensor 1 is connected to a ground and thus, the voltage is not generated.

3. When the flame sensor 1 discharges, an electric current flows in the flame sensor 1 and a potential difference occurs between both ends of the voltage dividing resistor 14.

4. Whether the voltage has been generated in the downstream side of the flame sensor 1 is detected by the voltage detecting circuit 15.

5. The central processing unit 163 computes the discharge probability using the number of rectangular triggers sent to the applied voltage generating circuit 12 and the number of times that a predetermined voltage is detected by the voltage detecting circuit 15.

(3) Basic Principle of the Present Invention

The flame detecting system which uses the photoelectric effect obtains the quantity of received light according to the following operation principle and thus, the operation principle will be described.

It is considered that a probability that discharge occurs when a single photon collides with a photoelectric sensor is $P_1$ and a probability that discharge occurs when two photons collide with the photoelectric sensor is $P_2$. Since $P_2$ is an inverse of a probability that discharge does not occur when a first photon collides with the photoelectric sensor and also when a second photon collides with the photoelectric sensor, a relationship between $P_i$ and $P_2$ is expressed as Equation 1.

$$(1-P_2)=(1-P_1)^2 \quad \text{[Equation 1]}$$

In general, when a probability that discharge occurs when n photons impinge on the sensor and a probability that discharge occurs when m photons impinge on the sensor are assumed as $P_n$ and $P_m$, respectively, Equation 2 and Equation 3 are established similar to Equation 1.

$$(1-P_n)=(1-P_1)^n \quad \text{[Equation 2]}$$

$$(1-P_m)=(1P_1)^m \quad \text{[Equation 3]}$$

Equation 4 to Equation 6 are derived from Equation 2 and Equation 3 as a relationship between $P_n$ and $P_m$.

$$(1-P_n)^{\frac{1}{n}} = (1-P_m)^{\frac{1}{m}} \quad \text{[Equation 4]}$$

$$(1-P_n)^{\frac{m}{n}} = (1-P_m) \quad \text{[Equation 5]}$$

$$\frac{m}{n} = \log_{(1-P_n)}(1-P_m) \quad \text{[Equation 6]}$$

When it is assumed that the number of photons incoming to the electrode per unit time is E and a time period during which a voltage greater than or equal to the discharge starting voltage is applied (hereinafter, referred to as a "pulse width") is T, the number of photons that collide with the electrode per each voltage application is represented as E*T.

When the same flame sensor is caused to operate in a certain condition A and another condition B, a relationship among the number of photons E, the time period T, and the probability P is represented by Equation 7. In addition, if the number of photons to be assumed as a reference is set to $E_0$ and $Q=E/E_0$ is set, Equation 8 is derived. Q is referred to as a quantity of received light. The quantities of received light for the condition A and the condition B are $Q_A$ and $Q_B$, respectively.

$$\frac{E_B T_B}{E_A T_A} = \log_{(1-P_A)}(1-P_B) \quad \text{[Equation 7]}$$

$$\frac{Q_B T_B}{Q_A T_A} = \log_{(1-P_A)9}(1-P_B) \quad \text{[Equation 8]}$$

Next, a basic flow of the quantity of received light calculation which is a main part of the present invention will be described using operations of the central processing unit 163. The central processing unit 163 is configured by a CPU.

Figure 3:
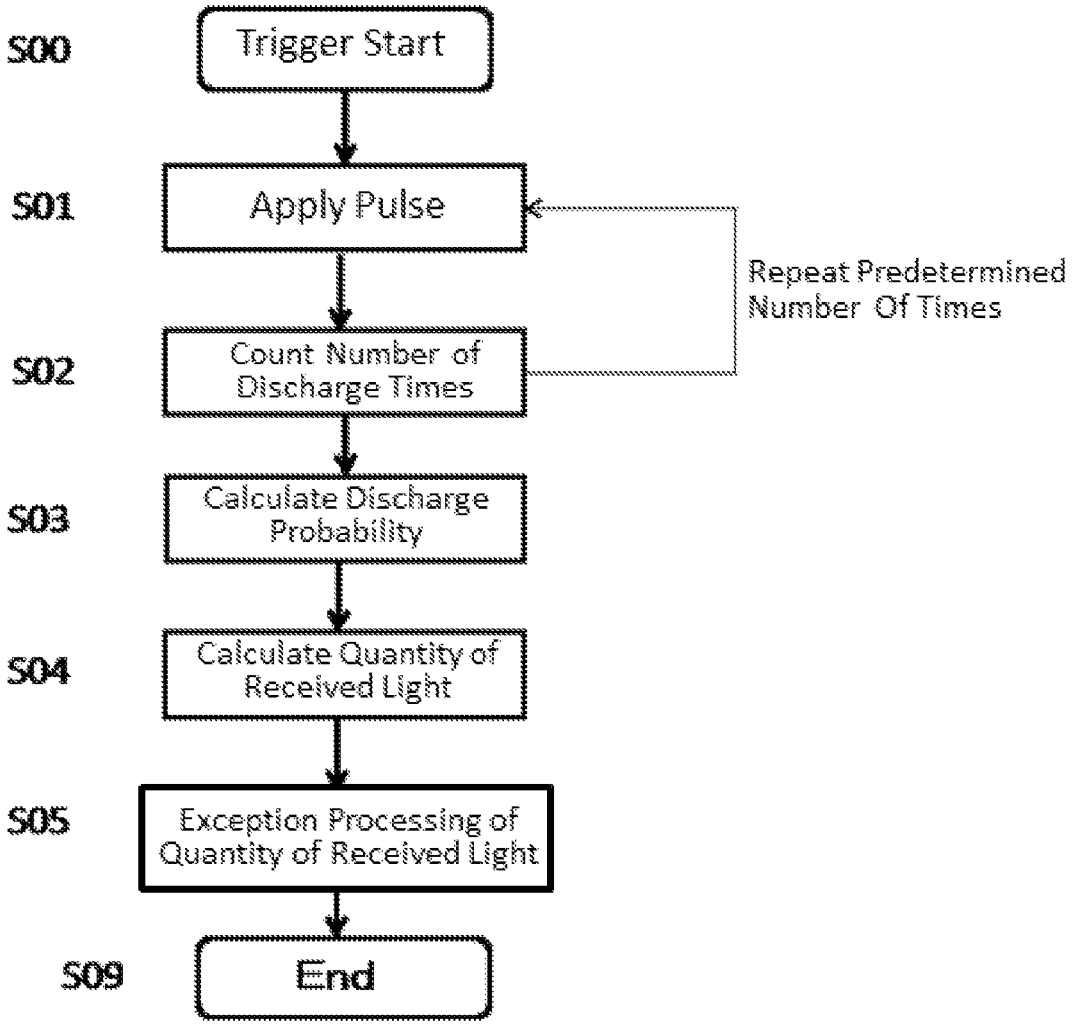
FIG. 3 illustrates a flow of a central processing unit which is basic processing for embodying the present invention.

A basic processing routine will be described based on the flow of FIG. 3 (step in the figure is denoted by Snn). The operations of the central processing unit 163 are formed of steps for driving the flame sensor 1 with a pulse voltage and calculating the quantity of received light for the flame from a driven result of the flame sensor 1.

A predetermined trigger is received and the flow is started (S00).

The flame sensor is driven to operate the applied voltage generating circuit 12 to apply the voltage greater than or equal to the discharge starting voltage to the flame sensor 1 using a rectangular pulse T having a certain width (S01).

The number of discharge times of the flame sensor 1 caused by repeatedly applying the pulse T to the flame sensor 1 for a predetermined number of times is counted by the signal obtained through the voltage detecting circuit 15 (S02).

The discharge probability P is calculated from the number of discharge times and the number of applied pulses (S03).

The quantity of received light is calculated from the discharge probability (S04). In a case where the discharge probability is other than 0 or 1, the quantity of received light is obtained using a digital calculation by a predetermined expression.

In a case where the discharge probability is 0, the quantity of received light is assumed as 0. A case where the discharge probability is 1 is excluded from a target to be calculated (S05).

In Equation 9, it is assumed that a discharge probability $P_A$ based on a quantity of received light $Q_A$ under a certain operation condition and a pulse width $T_A$ under the condition has already been known. The discharge probability is, for example, measured based on the quantity of received light and the pulse width that are determined in advance in a shipment inspection of the flame sensor 1 and is stored in the storing portion 162. It will be a principle by which the quantity of received light $Q_B$ can be obtained.

$$Q_B = \frac{Q_A T_A}{T_B} \log_{(1-P_A)}(1 - P_B) \quad \text{[Equation 9]}$$

EXAMPLE

Next, on the basis of Equation 9, when it is assumed that a condition during measurement of the flame 300 which is a measuring target, that is, when the reference light source 200 is not turned on is denoted by a subscript F, a condition during measurement for the sensitivity correction, that is, when the reference light source 200 is turned on is denoted by a subscript F+L, a quantity of received light of the flame 300 is denoted by a quantity of received light $Q_F$, and a quantity of received light of the reference light source 200 is denoted by a quantity of received light $Q_L$, Equations 10 and 11 are established. In a case of the present example, the quantity of received light $Q_A$ is a quantity of received light obtained by assuming that a pulse width is a pulse width $T_A$, and a discharge probability is the discharge probability $P_A$.

$$Q_F = \frac{Q_A T_A}{T_F} \log_{(1-P_A)}(1 - P_F) \quad \text{[Equation 10]}$$

$$Q_F + Q_L = \frac{Q_A T_A}{T_{F+L}} \log_{(1-P_A)}(1 - P_{F+L}) \quad \text{[Equation 11]}$$

A basic principle on which the quantity of received light Q is obtained by controlling the pulse width T to measure the discharge probability P ($PF_F$ and $P_{F+L}$) is adopted and thus, if the quantity of received light $Q_L$ and the discharge probability $P_{F+L}$ of the reference light source 200 are known, unknown numbers in Equation 11 are the quantity of received light $Q_F$ and the discharge probability $P_A$ of the flame 300.

Next, when a difference between Equation 10 and Equation 11 is obtained, Equation 12 can be obtained.

$$Q_L = \frac{Q_A T_A}{T_{F+L}} \log_{(1-P_A)}(1 - P_{F+L}) - \frac{Q_A T_A}{T_F} \log_{(1-P_A)}(1 - P_F) \quad \text{[Equation 12]}$$

In the following, Equation 13 to Equation 16 can be obtained by transforming Equation 12.

$$Q_L = \log_{(1-P_A)}(1 - P_{F+L})^{\frac{Q_A T_A}{T_{F+L}}} - \log_{(1-P_A)}(1 - P_F)^{\frac{Q_A T_A}{T_F}} \quad \text{[Equation 13]}$$

$$Q_L = \log_{(1-P_A)} \frac{(1 - P_{F+L})^{\frac{Q_A T_A}{T_{F+L}}}}{(1 - P_F)^{\frac{Q_A T_A}{T_F}}} \quad \text{[Equation 14]}$$

$$1 - P_A = \left[ \frac{(1 - P_{F+L})^{\frac{1}{T_{F+L}}}}{(1 - P_F)^{\frac{1}{T_F}}} \right]^{\frac{Q_A T_A}{Q_L}} \quad \text{[Equation 15]}$$

$$P_A = 1 - \left[ \frac{(1 - P_{F+L})^{\frac{1}{T_{F+L}}}}{(1 - P_F)^{\frac{1}{T_F}}} \right]^{\frac{Q_A T_A}{Q_L}} \quad \text{[Equation 16]}$$

Here, regarding the flame sensor 1, the discharge probability $P_A$ which is an index serving as the current sensitivity of the flame sensor 1 is obtained from Equation 16 by using the quantity of received light and the pulse width that are accumulated in the storing portion 162 by measuring values that are determined as the reference values at the time of shipment as the $Q_A$ and the $T_A$, acquiring the $Q_L$ of the reference light source from the quantities of received light accumulated in a similar manner, and using the pulse width and the discharge probabilities that are actually measured as the pulse width T and the discharge probabilities $PF_F$ and $P_{F+L}$. Furthermore, when the obtained $P_A$ is substituted for Equation 10 by inverse computation, the current quantity of received light $Q_F$ of the flame 300 which is an unknown number may also be obtained. By doing this, light intensity of the flame 300 which is a measuring target is obtained even during measurement for the sensitivity correction (during the reference light source being turned on).

Figure 4:
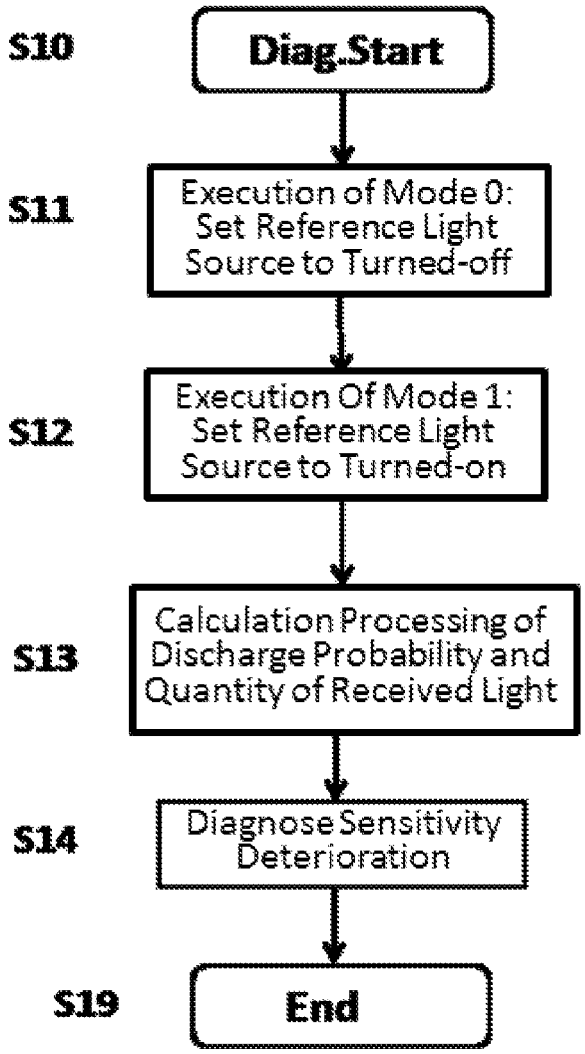
FIG. 4 illustrates a flow of a central processing unit which is an embodied aspect of the present invention.

The diagnosis steps which are an embodiment of the present invention are described on the basis of a flow of FIG. 4 (step in the figure is denoted by Snn).

In the present adjustment flow, parameters of a flame sensor at two modes are measured.

The diagnosis processing is started (S10).

mode 0: A discharge probability $P_L$ is measured in a state where a reference light source is turned off (S11).

mode 1: A discharge probability $P_{F+L}$ is measured in a state where a reference light source is turned on (S12).

Each of the two modes is configured by executing a basic routine (illustrated in FIG. 3) a plurality of times in order to obtain a predetermined number of samples.

The current discharge probability $P_A$ is calculated by calculating Equation 10 to Equation 16 and the quantity of received light $Q_F$ is calculated from Equation 10 by performing inverse computation (S13).

The discharge probability $P_A$ is compared with a threshold determined in advance to detect deterioration of the flame sensor 1 (S14).

Switching of modes is performed by instructions from the central processing unit 163 of the calculating device 3 and corresponds to controlling on/off of the reference light source 200.

In addition, various modifications can be made. Such design modifications are also included in a scope of the present invention.

DESCRIPTION OF REFERENCE NUMERALS AND SIGNS

1: flame sensor
2: external power supply
3: calculating device
11: power supply circuit
12: applied voltage generating circuit
13: trigger circuit
14: voltage dividing resistor
15: voltage detecting circuit
16: sampling circuit
161: A/D converting portion
162: storing portion
163: central processing unit
164: determining portion
200: reference light source
300: burner flame.

The invention claimed is:

1. A flame detecting system comprising:

a flame sensor configured to detect light;

a calculating device; and a reference light source, wherein the calculating device comprises:

an applied voltage generating portion configured to generate a pulse to drive the flame sensor, a voltage detecting portion configured to measure an electric signal flowing in the flame sensor, a storing portion configured to store sensitivity parameters of the flame sensor in advance, and a central processing unit configured to obtain a quantity of received light of flame using parameters of a known quantity of received light, a pulse width, and a discharge probability of the sensitivity parameters, and a discharge probability obtained from an actual pulse width and the measured number of discharge times, and wherein the central processing unit is configured to execute a first mode at which the discharge probability in the flame sensor is measured when the reference light source is turned off and a second mode at which the discharge probability in the flame sensor is measured when the reference light source is turned on, and calculate a current discharge probability of the flame sensor from data obtained at the first mode and the second mode.

2. The flame detecting system according to claim 1, wherein the central processing unit is configured to obtain a quantity of received light of the flame from the current discharge probability of the flame sensor.

3. The flame detecting system according to claim 1 or 2, wherein a deterioration diagnosis of the flame sensor is performed by comparing the current discharge probability with a predetermined threshold.

* * * * *